US006112917A

United States Patent [19]

Baker et al.

[11] Patent Number: 6,112,917

[45] Date of Patent: Sep. 5, 2000

[54] MOVEABLE FILE STORAGE SUPPORTING APPARATUS

[75] Inventors: Edward A. Baker, Novi; Thomas M. Campau, Grosse Pointe Woods, both of Mich.

[73] Assignee: Denstor Mobile Storage Systems, Inc., Farmington Hills, Mich.

[21] Appl. No.: 09/197,890

[22] Filed: Nov. 23, 1998

[51] Int. Cl.[7] ..... A47B 53/02; F16C 19/00

[52] U.S. Cl. ..... 211/162; 312/201; 384/58; 414/749

[58] Field of Search ..... 211/162, 1.51, 211/1.56, 151; 312/198–201; 414/749–750; 49/360, 361, 410; 104/244–248; 105/355–356, 328, 404; 384/58, 53, 50; 74/89.21, 89.2

[56] References Cited

U.S. PATENT DOCUMENTS

| | | | |
|---|---|---|---|
| 2,166,704 | 7/1939 | Foulkes | 312/199 |
| 2,772,639 | 12/1956 | Ingold | 312/199 |
| 2,812,069 | 11/1957 | Trammell | 211/162 |
| 2,915,195 | 12/1959 | Crosby . | |
| 3,047,095 | 7/1962 | Bell et al. | 211/162 X |
| 3,198,592 | 8/1965 | Zippel | 312/198 |
| 3,427,085 | 2/1969 | Staller . | |
| 3,563,180 | 2/1971 | Rutledge | 104/410 |
| 3,640,595 | 2/1972 | Staller et al. . | |
| 3,865,446 | 2/1975 | Mastonardi | 312/201 |
| 3,923,354 | 12/1975 | Young | 312/201 |
| 3,944,309 | 3/1976 | Taniwaki | 312/198 |
| 3,967,868 | 7/1976 | Baker, Jr. . | |
| 4,017,131 | 4/1977 | Camenisch . | |
| 4,229,135 | 10/1980 | Malmros . | |
| 4,256,355 | 3/1981 | Yamaguchi et al. . | |
| 4,307,922 | 12/1981 | Rhodes, Jr. | 312/198 |
| 4,379,602 | 4/1983 | Iemura et al. . | |
| 4,412,772 | 11/1983 | Naito et al. . | |
| 4,417,524 | 11/1983 | Quinn et al. | 104/410 |
| 4,462,500 | 7/1984 | Konstant et al. | 211/151 |
| 4,597,615 | 7/1986 | Steger | 312/201 |
| 4,618,191 | 10/1986 | Peterman . | |
| 4,708,411 | 11/1987 | Peterman . | |
| 4,789,210 | 12/1988 | Weiss et al. | 312/201 |
| 4,802,622 | 2/1989 | Homan . | |
| 5,004,304 | 4/1991 | Segerpalm et al. . | |
| 5,013,101 | 5/1991 | Muth . | |
| 5,069,513 | 12/1991 | Farrell et al. | 312/201 |
| 5,072,838 | 12/1991 | Price, Jr. et al. | 211/162 |
| 5,160,189 | 11/1992 | Johnston et al. | 312/201 |
| 5,265,739 | 11/1993 | Price, Jr. et al. | 211/162 |
| 5,341,944 | 8/1994 | Latino | 211/162 |
| 5,360,262 | 11/1994 | Davidian | 312/201 |
| 5,366,335 | 11/1994 | Tokiwa | 414/749 |
| 5,435,639 | 7/1995 | Smits et al. | 312/201 |
| 5,439,281 | 8/1995 | Croker . | |
| 5,597,217 | 1/1997 | Hoska et al. . | |
| 5,683,155 | 11/1997 | Sarno | 312/201 |

*Primary Examiner*—Daniel P. Stodola
*Assistant Examiner*—Jennifer E. Novosad
*Attorney, Agent, or Firm*—Harness, Dickey & Pierce, PLC

[57] ABSTRACT

A large capacity mobile storage system having a plurality of storage units and a plurality of interconnected support assemblies for rolling movement. Each of the support assemblies includes a frame and a pair of spherical shaped hardened steel support wheels. Only one of the support assemblies includes a pair of guide rollers disposed perpendicular to its associated support wheels in order to maintain rolling movement of the storage system along a linear path. The support wheels of the other support assemblies are allowed to move independently from one another in order to prevent the scrubbing action of the supporting apparatus. The supporting assemblies also include a drive track and a sprocket disposed at one end of the storage unit with a drive mechanism. This feature helps to keep the floor area between the flat tracks uncluttered. The apparatus compensates for a significant degree of unlevelness and undulation of the flat tracks caused by an unlevel floor upon which the flat tracks are mounted.

12 Claims, 4 Drawing Sheets

MOVEABLE FILE STORAGE SUPPORTING APPARATUS

BACKGROUND OF THE INVENTION

1. Technical Field

This invention is related to storage systems, and more particularly to an apparatus for movably supporting a storage system for rolling movement along a plurality of flat tracks secured to a floor without the use of a carriage for supporting the storage units of the system.

2. Background

Moveable file storage apparatuses are used in a wide variety of applications to increase storage density, and particularly in applications where a large amount of inventory or various items are stacked on large shelving units that need to be accessed periodically. Such systems typically include a number of moveable storage units positioned adjacent one another on a plurality of tracks or guide rails to form an elongated row. Each row of storage units are interconnected such that an entire row can be moved easily along the tracks or guide rails to allow access to adjacently positioned rows of storage units. Thus, by movably supporting various rows of storage units, the floor space required for any given number of rows of storage units is reduced dramatically. This significantly reduces the cost of storing inventory and other articles such as files, books, etc. by allowing a significantly larger number of such articles to be stored in any given space. These forms of moveable storage systems find particular utility in warehouses and other like buildings, but are just as easily adaptable to office settings to store books, files, X-rays and other forms of records which need to be accessed periodically by office personnel.

Such storage systems as described above typically employ a "carriage" which is a rigid, rectangular, frame-like device comprised of a plurality of interconnected members which runs the full length of a row of storage units supported thereon. The carriage includes typically several pairs of spaced apart wheels or rollers. The wheels or rollers enable the entire carriage to be moved along two or more parallel placed guide tracks, which are often V-groove type tracks. Each row of movable storage units thus requires its own carriage so that each row can be moved independently of the other rows. Thus, a storage system incorporating two movable rows of storage units will need two carriages, a system with three movable rows of storage units will require three carriages, and so forth.

The carriage has heretofore been necessary for providing easy rolling movement of medium to long rows of movable storage units because of the insufficient structural integrity of most side-by-side storage units configured in a long row. Simply supporting the storage row at various points by a plurality of pairs of wheels or rollers has not traditionally been thought to be a workable option because the various sections making up a medium to long length row of storage units, without being supported by a highly structurally rigid carriage, would tend to move not perfectly simultaneously together, but rather one or more sections would slightly lead or lag relative to the other sections. Usually, the portion of the storage row which is driven by a gear or sprocket will tend to "lead" the other portions of the storage row. This causes the wheels to want to roll along paths not straight and parallel to one another. In the art this is termed "racking".

With systems employing V-groove tracks mounted to the floor, the wheels which are not moving in straight paths will tend to bind as they try to move in a slight arc and will tend to want to climb out of the V-groove of the track. With systems employing a flat track and wheels having a flat (i.e., non-radiused) rolling surface, a "scrubbing" action of the wheels along the track surfaces will occur when all of the wheels are not rolling in perfectly parallel paths. This scrubbing action will impede smooth rolling movement and require an individual to use additional force to move the entire storage row. It will also significantly increase the wear and tear of the wheels and the track. Thus, the use of a highly rigid carriage incorporating several pairs of spaced apart parallel wheels has been necessary to ensure that all of the wheels roll along paths that are as straight as possible, and that the wheels run along perfectly parallel paths. The need to install the tracks precisely parallel is equally important in obtaining satisfactory operation of such conventional systems.

Even when using a highly structurally rigid carriage, however, the problem of an unlevel floor can still produce the above-described problems. Shimming the tracks on which the wheels of the carriage roll can often help to reduce the effects of the unlevel floor, but it is often difficult, or impossible, to completely correct the unlevelness of the tracks. Floor unlevelness can also significantly increase the force needed to roll the storage row along its tracks.

Further to the above, the carriage represents a significant cost of a movable storage system. Due to its size and weight, the carriage also adds significantly to the cost of shipping the storage system. Since assembly of the carriage(s) is/are required at the site where the movable storage system is to be installed, the time, and thus the cost, of installation is increased. The use of the carriages also complicates the installation and requires a more highly skilled installation worker to assemble and install the movable storage system, as well as to carefully and precisely install the tracks. The tracks need to be carefully installed precisely parallel to one another and shimmed, if necessary, to ensure that the tracks are as level as possible relative to each other, and that each track is also level end-to-end. Thus, it would be highly desirable to provide a movable storage system which provides for a very smooth, low effort rolling action without the need for a conventional carriage.

It would also be highly desirable to provide a movable storage system where the storage units are supported at a plurality of points by rollers or wheels which ride on flat tracks, and where the rollers or wheels are not subject to the scrubbing action described above if the rollers move along a slight arc rather than a perfectly straight (i.e., linear) path.

It would also be highly desirable to provide a movable storage system which does not require a carriage for supporting the various storage sections, and which further incorporates a plurality of support wheels which are able to "float" on corresponding flat tracks such that the scrubbing action described above is essentially eliminated when the support wheels are not moving in perfectly straight, parallel paths.

It would also be highly desirable to provide a movable storage system which can be driven at one longitudinal end thereof by a gear or sprocket, which does not require a carriage, and which incorporates a plurality of radiused support wheels which are allowed to "float" over corresponding flat tracks to thereby essentially eliminate the scrubbing action suffered by prior art movable storage systems.

SUMMARY OF THE INVENTION

The present invention is directed to a mobile storage apparatus which does not require the use of a conventional carriage. The apparatus incorporates a plurality of flat steel tracks spaced apart from one another and positioned generally parallel to one another along a floor, and secured fixedly to the floor. A plurality of support assemblies are disposed under each upright of each storage unit making up a single row of storage units.

Each support assembly is supported by a pair of support wheels which each have a radiused or spherical surface such that the wheels only make a "point" contact with the flat track on which they roll. Since each support assembly is independent of the other support assemblies, and since the support wheels only make point contact with their respective flat tracks, the support wheels of each support assembly are able to "float" or move freely over the flat tracks even when the wheels are not moving in perfectly parallel paths to one another. Put differently, the independent support assemblies and the spherical wheels enable the wheels of each support assembly to move along slightly non-linear paths, as needed, so that the entire storage row can still be moved freely even when the lack of structural integrity of the storage units causes one or more sections thereof to lead or lag the others as the entire row is moved. The point contact provided by the spherical support wheels, together with the flat tracks, essentially eliminates the scrubbing action that would occur with flat support wheels. The use of flat tracks rather than V-groove or other tracks having a raised, guiding portion ensures that no "binding" action will occur if certain ones of the support wheels move in a non-linear path.

Since the apparatus of the present invention requires no carriage, the overall cost of the storage system is reduced significantly, along with the costs associated with shipping the apparatus and installing same. Moreover, the installation of the storage system of the present invention is simplified such that the storage apparatus can be installed more quickly and easily than with previously developed storage systems which require a carriage.

An additional advantage of the storage apparatus of the present invention is that the smooth rolling movement is not as dependent on the levelness and straightness of the tracks, as is the case with prior systems. With prior storage systems using V-groove or other tracks having a raised portion which guides or restrains the support wheels, the parallel alignment of the tracks, along with the levelness of the tracks, is critical to obtaining a smooth rolling action of a row of storage units. Thus, very precise and careful installation of the tracks is required. With the present invention, the alignment and levelness of the tracks is not nearly as critical. In effect, the present invention, because of the manner in which the support wheels are allowed to float over the flat tracks, accommodates a significant degree of unlevelness or undulation of the tracks. Furthermore, since the support wheels are not restrained in a V-groove or by any other raised portion of the track, precise parallel alignment of the tracks is not a critical factor to obtaining proper operation of the invention. Thus, the installation is further simplified because the present invention accommodates a degree of non-parallel positioning of the tracks, such that precise parallel positioning is not a critical element for obtaining proper operation of the invention.

Still another advantage provided by the present invention is the ability to drive an entire storage row of interconnected storage units at only one point, and in one preferred embodiment from an end of the storage row, with only a single drive element. Since the flat tracks and spherical wheels allow various sections of the storage row to either lag or lead the others slightly without causing a binding or scrubbing action of the support wheels, it becomes unnecessary that each storage unit of a row of units be driven. The extremely low rolling resistance provided by the present invention therefore enables an entire row of interconnected storage units to be driven by a single drive element such as a sprocket or gear. This further reduces the cost of the system by requiring a less complex drive mechanism. In some applications, the low rolling resistance will enable movement of an entire storage row without the need for a mechanical drive assist mechanism.

BRIEF DESCRIPTION OF DRAWINGS

The various advantages of the present invention will become apparent to one skilled in the art by reading the following specification and subjoined claims and by referencing the following drawings in which:

FIG. 7 is an alternative preferred embodiment of the present invention incorporating a Z-rail and anti-tip rail for preventing bouncing and/or tipping of the storage units.

DETAILED DESCRIPTION OF THE PREFERRED EMBODIMENTS

Figure 1:
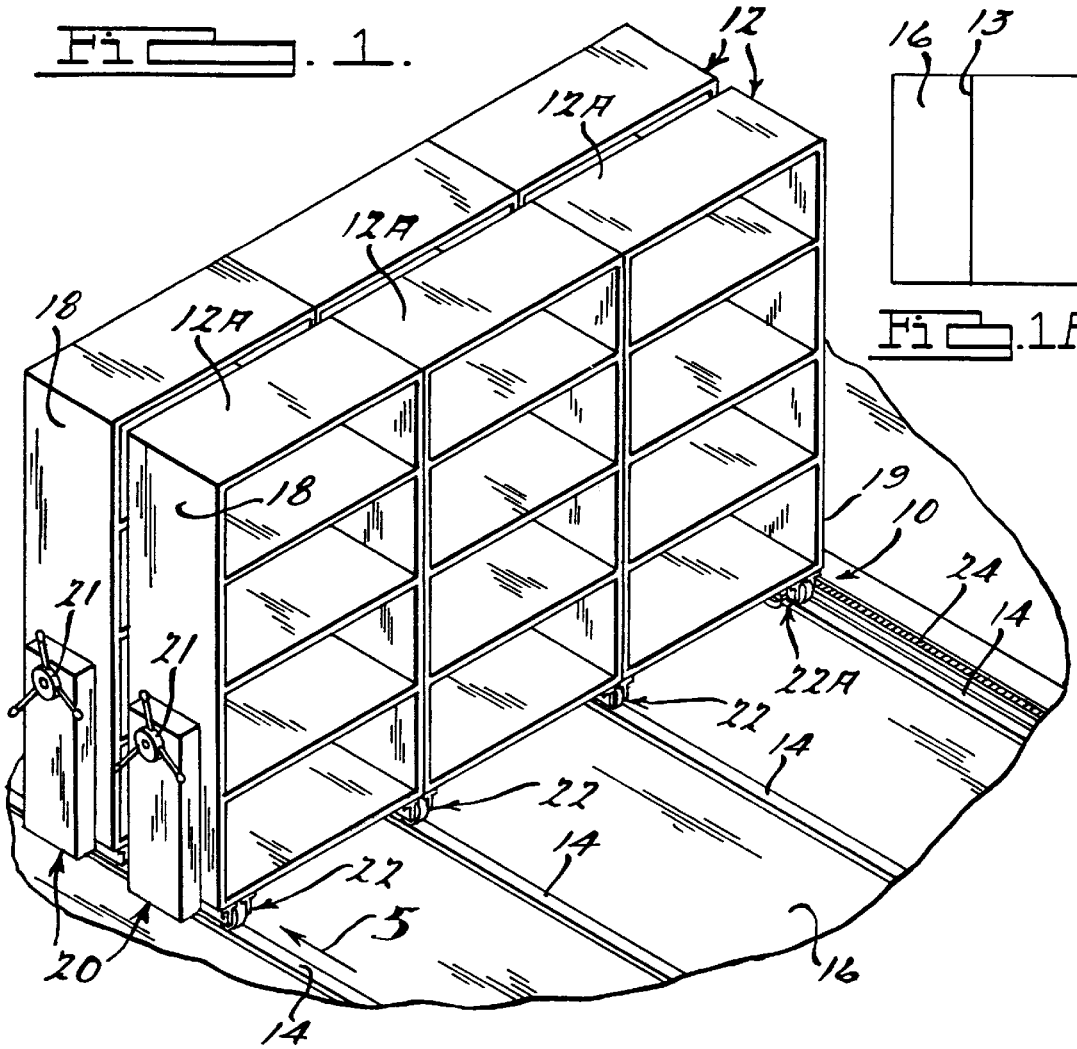
FIG. 1 is a perspective view of a pair of large-capacity storage units supported by the apparatus of the present invention for movement towards or away from each other.
Figure 1A:
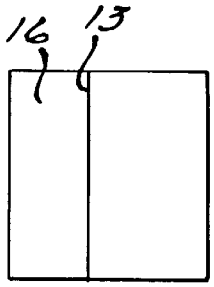
FIG. 1A is a simplified diagrammatic view of a non-linear path that the support wheels of one of the support assemblies may be required to take as one storage unit row is moved along the flat tracks.

Referring to FIG. 1, there is shown a storage supporting apparatus 10 in accordance with a preferred embodiment of the present invention. The apparatus 10 is used to movably support a plurality of rows of large capacity storage units 12, where each storage unit 12 is comprised of a plurality of independent but interconnected storage units 12A which are moved as a single row to permit access between any pair of adjacent rows of storage units 12. In practice, it will be appreciated that the storage units 12 are interconnected but still, in most instances, do not have sufficient structural integrity to move together perfectly simultaneously. Thus, in most instances, one or more of the sections 12A will lead or lag other ones of the sections 12A slightly as the entire row is moved. Put differently, one or more sections 12A will not remain perfectly parallel to its adjacent section as the entire row 12 is moved. In the art this is referred to as "racking". An example of a path that the wheels supporting one of the sections 12A may be forced to take is illustrated in FIG. 1A and is represented by a slightly wavy line 13. As will be described in the following paragraphs, the present invention accommodates this shortcoming in structural integrity by allowing the wheels supporting each storage section to "float" or move freely in non-linear paths so that a smooth rolling action of the entire row of storage units is still provided.

With further reference to FIG. 1, the apparatus 10 generally comprises a plurality of flat tracks 14 which are fixedly secured to a floor 16. The flat tracks are comprised of lengths of steel each having a thickness preferably between about 0.1875 inch to 0.5 inch, and a width of preferably between about 1.5"–2.0", although it will be appreciated that narrower or wider tracks could be used if desired. In some applications, it will be appreciated that materials other than steel, such as possibly plastic, could be used for the tracks 14.

At a first end 18 of each storage unit 12 is a user engageable drive assist mechanism 20. The drive assist mechanism 20 enables a user to easily move its associated storage unit 12 along the tracks 14 by providing a mechanical advantage through a suitable arrangement of gears. Each drive assist mechanism 20 includes a handle assembly 21 which the user turns rotationally to impart linear movement to its associated storage unit 12 via a drive chain (shown in FIGS. 3 and 5). Drive assist mechanism 20 is well-known in the art and will therefore not be described in detail.

Each storage unit 12 is further supported underneath its vertical upright portions by a pair of support assemblies 22, with each support assembly 22 being associated with a single one of the tracks 14. Advantageously, the support assembly 22 at a farmost end 19 of each storage unit 12 is driven along the flat track 14 via a sprocket which engages within an adjacently positioned drive track 24 secured fixedly to the floor 16. These components will be described momentarily in connection with the remaining figures. This arrangement helps to keep the floor area 16 relatively uncluttered such that individuals may walk more easily between the tracks 14 when placing items on the storage units 12 or retrieving items therefrom. The low profile of the flat tracks 14 serves to make the tracks much less obtrusive than higher profile V-groove tracks, and therefore easier to step over when placing or retrieving items from each storage unit 12.

Figure 2:
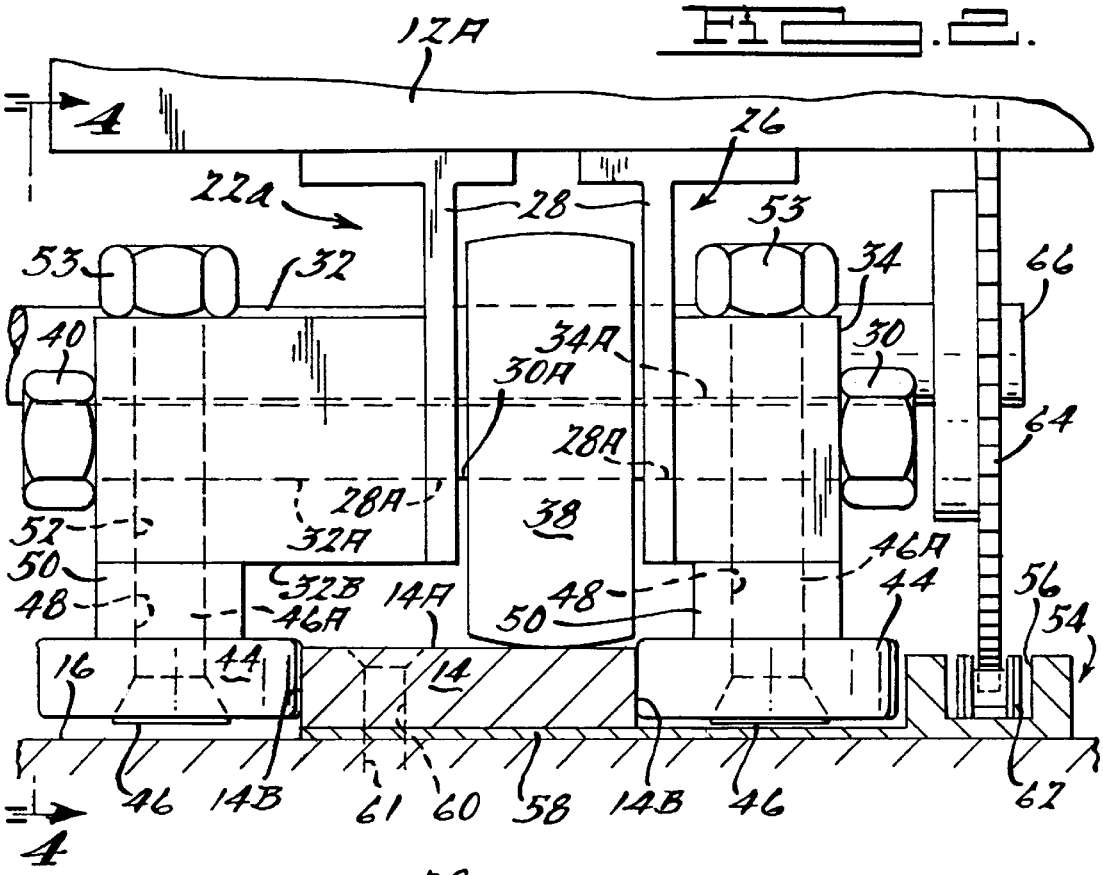
FIG. 2 is an end-view of the farmost support assembly illustrating the support assembly supported upon one flat track of the apparatus.
Figure 4:
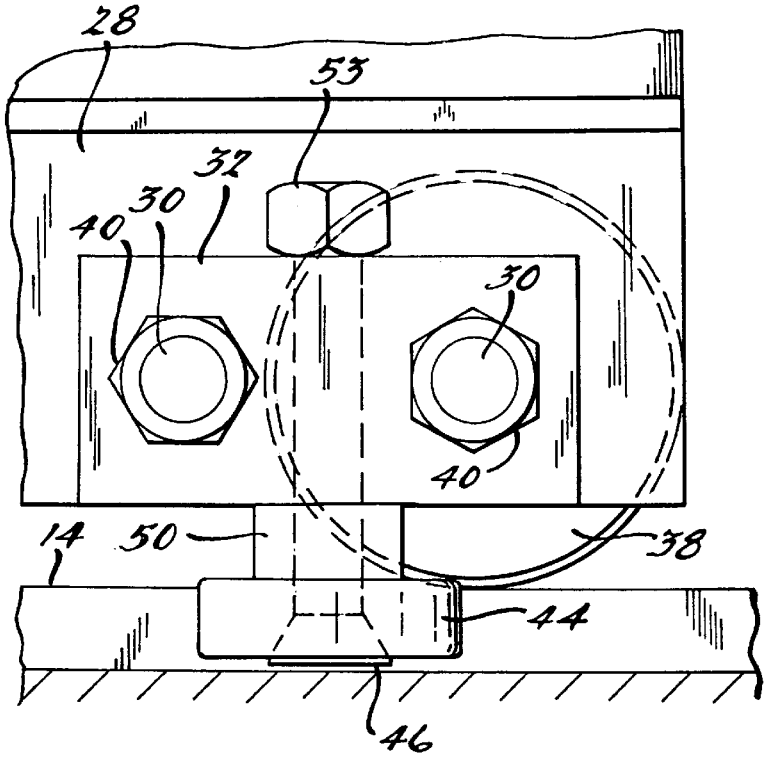
FIG. 4 is an enlarged side view of the support wheel and guide roller pair shown in accordance with directional line 4—4 in FIG. 2.

Referring now to FIG. 2, the support assembly 22*a* at the far end 19 of the storage unit 12 is shown in greater detail. The support assembly 22*a* comprises a frame 26 comprised of two elongated, generally T-shaped aluminum frame members 28. Each frame member 28 includes an opening 28A for receiving the shaft portion 30A of a bolt 30 therethrough. The shaft portion 30A also extends through openings 32A and 34A in spacer blocks 32 and 34, respectively, disposed against each of the frame members 28. The shaft 30A further extends through a bearing (not shown) supporting a radiused or spherically contoured, hardened steel support wheel 38 to form an axle for supporting the wheel 38. The bolt 30 is secured via a threaded nut 40 such that the entire assembly of frame members 28, blocks 32, 34 and support heel 38 is held together as a single unit. With brief reference to FIG. 4, a second bolt 42 also preferably extends through a second group of aligned openings in the blocks 32, 34 and the frame members 28 to further hold these components rigidly together as a single unit in identical fashion to that shown in FIG. 2.

Referring further to FIG. 2, a pair of guide rollers 44 are disposed on opposite sides of each support wheel 38 and orientated generally perpendicular to their associated support wheel 38. The leftmost guide roller 44 is secured to its associated block 32 by a threaded screw 46 which extends through a bore 48 in a spacer block 50, which is disposed against a lower surface 32B of the spacer block 32. A portion 46A extends through a bore 52 in the block 32 and a threaded nut 53 is secured to a threaded end portion of the screw 46 to hold the guide roller 44 securely to the block 32. The guide roller 44 on the opposite side of the wheel 38 is attached in similar fashion to the spacer block 34. In a preferred embodiment of the invention the blocks 32 and 34 may be extruded components having suitable openings for enabling the threaded screws 46 to extend therethrough. Although the threaded screws 46 and the guide rollers 44 are commercially available items, they form a plurality of convenient, cam follower arrangements for guiding the support wheels 38. Since the heads of the screws 46 are tapered, they help to "self-center" the guide rollers 44 while protruding only slightly outwardly of the guide rollers 44. This enables the guide rollers 44 to be disposed very close to the floor 16 without interference from the screws 46.

With further reference to FIG. 2, the blocks 32, 34 are of dimensions which separate the guide rollers 44 a distance approximately equal to, or just slightly larger than, the width of flat track 14. The blocks 50 have a height which laterally offsets each guide roller vertically such that each is disposed below the upper surface 14A of the track 14. In this manner, the guide rollers 44 are able to engage the side edges 14B of their associated flat track 14 to maintain rolling movement of the support wheels 38 of support assembly 22*a* on its associated flat track 14 in a predetermined linear path. The spherical outer surface of each wheel 38 further allows a single point contact to be maintained by the wheels 38 with the upper surface 14A of the flat track 14.

Figure 3:
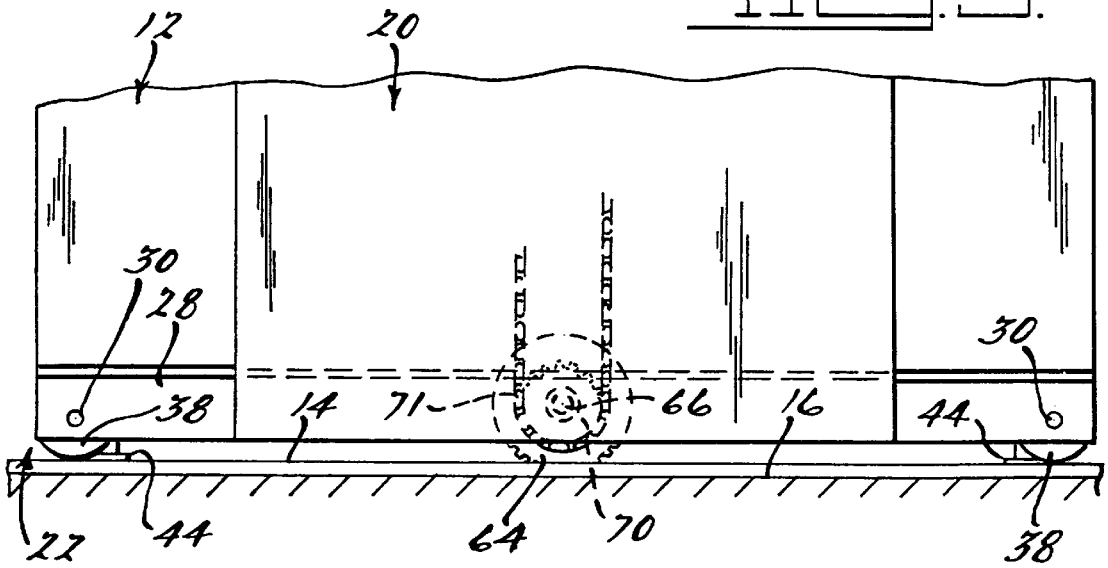
FIG. 3 is a side view of one of the support assemblies.
Figure 5:
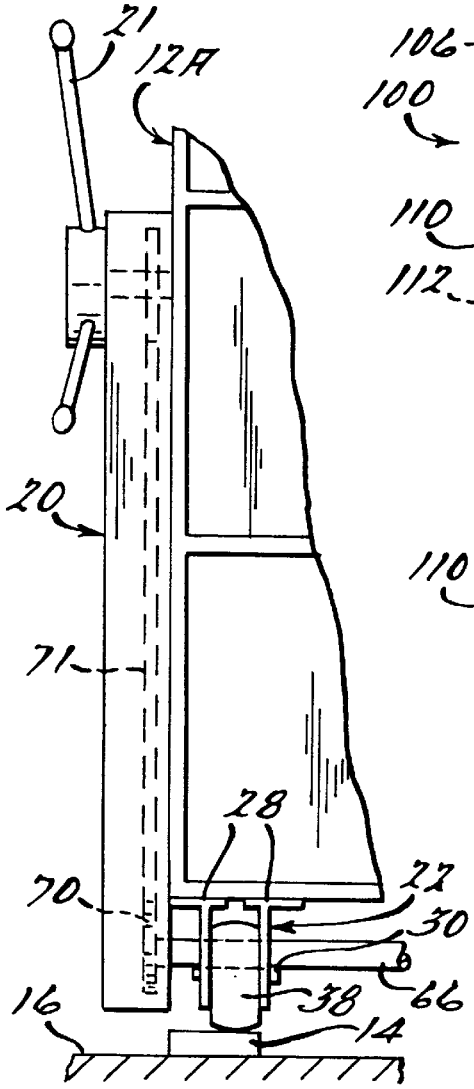
FIG. 5 is a front end view of the near (i.e., leftmost) end of the storage unit in accordance with directional arrow 5 in FIG. 1.

Referring briefly now to FIGS. 3 and 5, the leftmost support assembly 22 is illustrated. This assembly 22 also incorporates a pair of support rollers 38 which are secured between frame members 28 and supported for rolling movement by a bolt 30 forming an axle. It will be noted, however, that this support assembly, like the two intermediately support assemblies 22 visible in FIG. 1, does not include guide rollers 44. As such, only support assembly 22*a*, because of its guide rollers 44, is constrained to move in a perfectly linear path. The support assemblies 22, not using the guide rollers 44, are therefore allowed to move slightly independently of each other in non-linear paths as the various storage units 12A either lead or lag slightly relative to their adjacently positioned units 12A when the entire storage row 12 is moved. This important feature will be explained further momentarily after the invention is more thoroughly described.

With further reference to FIG. 2, an elongated drive track 54 having an upwardly opening channel 56 and a mounting portion 58 is positioned adjacent support assembly 22*a*. The mounting portion 58 of the drive track 54 is sandwiched between the floor 16 and the flat track 14 and secured to the floor 16 by threaded screws 61 extending through openings 60 in the flat track 14. However, mounting portion 58 could just as easily be omitted such that the flat track 14 rests directly on the floor 16. It will also be understood that the left spacer block 32 is wider than the right spacer block 34 so as to position the support wheel 38 associated with block 32 offset from the centerline of the flat track 14. This ensures that the support wheels 38 do not roll over the screws 61 securing the flat track 14 to the floor 16.

With further reference to FIG. 2, the channel 56 has a length of chain 62 which is secured fixedly therein. Engaging the chain is a drive sprocket 64 which is fixedly secured to a drive shaft 66. The drive shaft 66 extends through openings 68 in each of the frame members 28 of support assemblies 22 and 22*a*. Accordingly, movement of the drive sprocket 64 urges each entire support assembly 22 simultaneously along the flat track 14 with support assembly 22*a*. It will be appreciated, however, that while the drive sprocket 64 is shown as being associated with support assembly 22*a*, it could just as easily be configured to drive the storage row 12 at one of the other support assemblies 22 or at some intermediate point therebetween. Furthermore, the drive sprocket could easily be disposed to the left of the support assembly 22*a* in FIG. 2 if desired.

In many instances it will not be necessary at all to incorporate the drive assist mechanism 20, the drive shaft 66, sprocket 64, and the channel 56 with its chain 62. This is because of the extremely low resistance rolling movement provided by the spherical support wheels 38 on the flat tracks 14. Advantageously, however, when a drive assist mechanism is incorporated, the storage unit may be driven at only one point therealong.

With brief reference to FIG. 5, it will be appreciated that the opposite end of the drive shaft 66 is coupled to a sprocket 70 of the drive assist mechanism 20 such that a user turning the handle assembly 21 can impart movement to the drive-shaft 66 via a drive chain 71, and thereby move the entire storage unit 12. The sprocket 70 and chain 71 are also shown in FIG. 3.

It is a principal advantage of the present invention that spherically shaped wheels 38 are used on corresponding flat tracks 14, and that the support assemblies 22 are allowed to move independently of each other as the storage unit row 12 is moved. Even when the lack of structural integrity of the storage unit row 12 causes one or more sections 12A thereof to slightly lead or lag from an adjacent section 12A as the entire row 12 is moved, the support wheels 38, being spherically shaped, "float" over the upper surfaces of the flat tracks 14 to still provide a smooth, low effort rolling movement. The point contact made by the support wheels 38 with the flat tracks 14 also essentially eliminates the scrubbing action that previously developed systems incorporating flat support wheels have suffered from when the wheels are forced to move along a non-linear path. The present invention thus accommodates the slight non-linear rolling movement of various ones of the support wheels which support an elongated storage row such that the entire storage row can still be moved easily with a low degree of rolling effort. The present invention therefore provides an extremely low rolling resistance due to the floating movement of the support wheels 38, even when the wheels 38 are moving in slightly non-linear paths due to a lack of structural integrity of the storage unit 12.

Figure 1B:
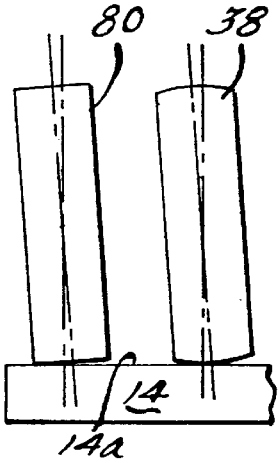
FIG. 1B is a simplified end view of one flat support wheel resting on a track, and one spherical support wheel resting on the same track, while each wheel is off axis loaded.

The spherical support wheels 38 of the present invention also accommodate a degree of off axis loading that may result during racking, or if portions of the floor are unlevel causing the upper surface of the track to be disposed not perfectly normal to the support wheel. This is illustrated in FIG. 1B, wherein a prior art flat wheel 80 is illustrated riding on one edge. In this condition, wheel 80 will tend to "dig in" to the support track 14 and will also want to roll in an arc rather than along a straight line. When it is forced to move along a straight line, a scrubbing action occurs on the surface 14A of the track 14. Wheel 38, however, still makes a point contact with the track 14 and will not tend to "dig in" or scrub the track 14 as the wheel 38 moves therealong. Thus, the present invention accommodates a degree of off axis loading which would otherwise cause the support wheels of prior art systems to want to bind along portions of the track or scrub along the surface of the track as they are moved.

Figure 6:
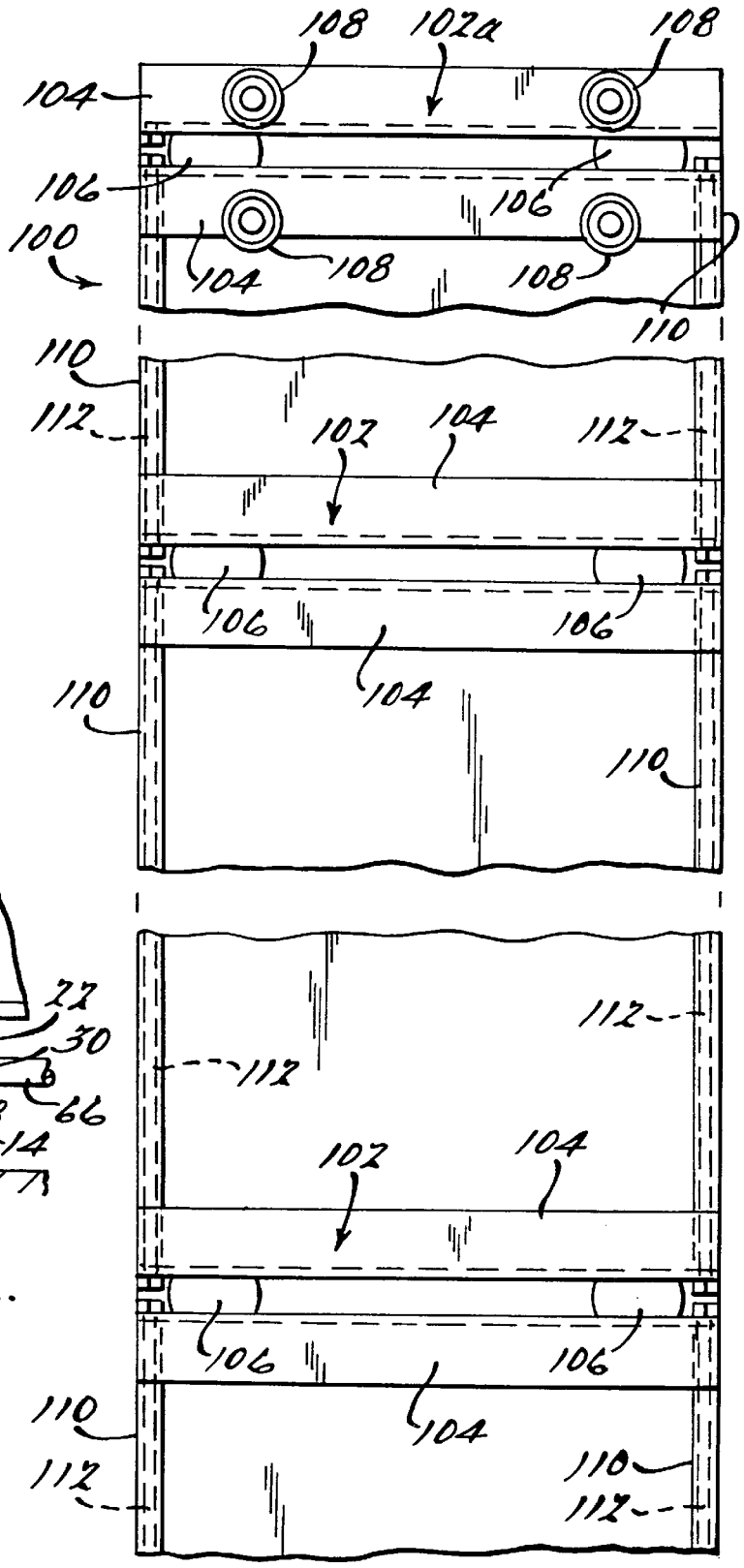
FIG. 6 is a plan view of a support assembly in accordance with an alternative preferred embodiment of the present invention incorporating lengths of conduits for prestressing the support assemblies to provide structural rigidity to the interconnected support assemblies.
Figure 5:
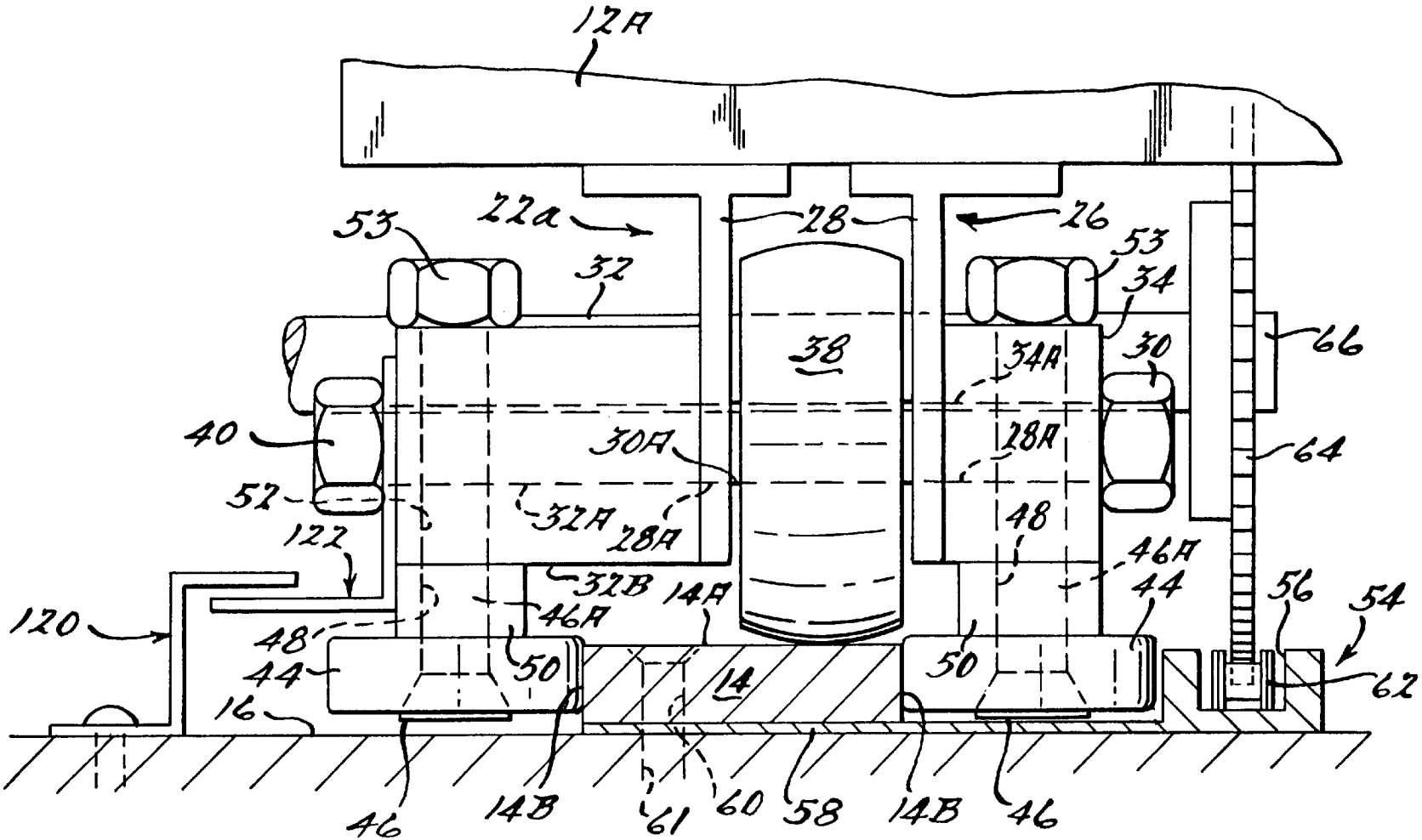

Referring now to FIG. 6, an alternative preferred embodiment 100 of the present invention is shown. This embodiment is effective for applications where the row of storage units is quite long, such as a fifteen foot long row, or when each storage unit is quite narrow in relation to its length, such as when using 9–15 inch deep storage units ganged together to form a single storage unit row. In these instances, the tendency for one or more of the storage units to "parallelogram" increases. By "parallelogram" it is meant that the storage unit changes from a perfectly rectangular configuration into a parallelogram where two of the sides are not perfectly perpendicular to the remaining two sides.

The apparatus 100 incorporates support assemblies 102 which each include a pair of frame rails 104. Each pair of frame rails 104 supports a pair of spherical support wheels 106 for rotational movement. One of the support assemblies 102*a* also includes two pairs of guide rollers 108 disposed perpendicularly to its associated support wheels 106 in a manner like that shown in FIG. 2.

The principal additional feature of this embodiment is that the frame rails 104 of adjacent support units 102 are coupled together by a pair of connecting rods 112 which extend through a pair of tubular members 110. Each tubular member 110 may vary in diameter but is preferably between about 0.5 inch–1.0 inch in diameter. The threaded connecting rods 112 extending through each tubular member 110 permit the frame rails 104 of adjacent storage units 102 to be securely attached to each other and "pre-stressed" to help prevent parallelogramming. Advantageously, the connecting rods 112 and the tubular members 110 still enable one support assembly 102 to twist slightly relative to an adjacent support assembly in the event the floor supporting the storage units 102 is not perfectly level. Thus, the support wheels 106 of each of the support assemblies 102 are able to follow the contour of their associated flat track even if the flat track has a slightly undulating surface due to unlevelness of the floor. The pre-stressing thus serves to enhance the structural rigidity of each storage unit to thereby minimize the parallelogramming without the need for a conventional carriage.

The various embodiments described herein thus provide a moveable storage apparatus which is less costly and easier to install than previously developed moveable storage systems. The apparatus of the present invention accommodates a significant degree of unlevelness of the floor supporting it, as well as a significant degree of racking, while still providing an exceptionally low rolling resistance movement. The exceptionally low rolling resistance is due to the spherical support wheels and the point contact which they make with their associated tracks, and the fact that the wheels of each support assembly 22 are not constrained in any form of V-groove or other non-flat track. The low rolling resistance enables more simplified mechanical assist drive arrangements to be incorporated and, in some instances, may completely eliminate the need for a mechanical drive assist mechanism.

Another significant advantage of the present invention is that the flat tracks also provide a very low profile which is much easier to step over when accessing items supported on the storage units 12A. Installation of the tracks is simplified since the positioning of the tracks and the levelness of each is not as critical to achieving a smooth rolling action as with previously developed systems.

While it will be appreciated that the foregoing description has been with reference to a multi-section storage row 12, the present invention is equally applicable to a single, elongated storage row. In this instance, the present invention will accommodate the leading or lagging of portions of the storage row just as with a multi-section storage row.

With brief reference now to FIG. 7, the support assembly 22*a* of FIG. 2 is shown but with the addition of a Z-rail 120 secured to the floor 16 by a suitable anchor, and an L-shaped bracket 122 secured to the block 32. The Z-rail 120 preferably runs the entire length of the flat track 14 while the bracket 122 is preferably long enough to span the length of the support assembly 26. The bracket 122 is secured to the block 32 by bolt 32 and nut 40.

The bracket 122 and Z-rail 120 are preferably each made from aluminum or steel and spaced close to one another as shown in FIG. 7. The bracket 122 engages the Z-rail 120 if the storage unit 12A begins to tip or bounce during operation. It will be appreciated, however, that such action is not normal and would occur, if at all, in most instances only when the storage unit 12A is very lightly loaded and is pushed into abrupt contract with an adjacent storage unit 12A. In such instances the Z-rail 120 and bracket 122 cooperate to limit bouncing or tipping of the storage unit 12A on the flat tracks 14.

Those skilled in the art can now appreciate from the foregoing description that the broad teachings of the present invention can be implemented in a variety of ways. Therefore, while this invention has been described in connection with particular examples thereof, the true scope of the invention should not be so limited since other modifications will become apparent to the skilled practitioner upon a study of the drawings, specifications and following claims.

What is claimed is:

1. A large capacity movable storage supporting apparatus for movably supporting a storage system, the storage system including at least one storage unit, the storage supporting apparatus comprising:

a plurality of generally rectangular flat tracks secured to a floor generally parallel to one another;

a plurality of corresponding support assemblies for directly supporting said storage system at spaced apart points along said storage system;

each of said support assemblies including a pair of rotationally supported support wheels for supporting said storage system for rolling movement in accordance with one of said flat tracks, each of said support wheels having a spherical surface for engaging its associated flat track;

a pair of rotationally supported guide rollers in association with only one of said support assemblies for maintaining rolling movement of said support wheels in a generally linear path on said flat track;

an elongated drive track fixedly disposed to said floor adjacent to the flat track secured farthest from a user engageable drive mechanism;

a drive shaft operably interconnected with all of said support assemblies;

a drive element fixedly coupled to said drive shaft and engaged with said drive track; and said user engageable drive mechanism operably associated with said drive shaft to enable rotation of said drive shaft, to thereby cause said drive element to drive said support assemblies simultaneously along said flat tracks with low rolling resistance, wherein said support assemblies which do not incorporate said guide rollers move independently of each other in a non-linear path.

2. The apparatus of claim 1, wherein said drive track comprises an elongated chain.

3. The apparatus of claim 1, wherein said drive element comprises a sprocket.

4. The apparatus of claim 1, wherein each of said support assemblies comprises a pair of generally T-shaped frame members and at least a pair of axles extending therebetween, each of said axles being associated with one of said support wheels.

5. The apparatus of claim 1, wherein each of said support assemblies are interconnected to its adjacent said support assembly by a pair of elongated members to inhibit said storage unit from changing configuration from a rectangle into a parallelogram as said drive element drives said support assemblies along said flat tracks.

6. An apparatus for movably supporting a storage system on a floor comprising:

a plurality of generally rectangular flat tracks fixedly disposed on the floor generally parallel to one another;

a corresponding plurality of support assemblies, each of said support assemblies including a pair of vertically oriented support wheels each having a spherical profile and a frame for supporting said support wheels rotationally thereon;

only one of said support assemblies including a pair of guide rollers rotationally supported by said frame so as to face opposite side edges of said flat track when said one support assembly is disposed with its said support wheels resting on one of said flat tracks;

an elongated drive track including:

a secondary track member adapted to be fixedly secured to said floor and to be disposed adjacent to one of said flat tracks; and an elongated chain disposed fixedly within said secondary track member, wherein said secondary track member and said flat track each include openings therethrough such that said secondary track member can be secured between a lower surface of said flat track and said floor by at least one threaded member extending into said floor;

a drive shaft operably interconnecting each of said support assemblies so as to move each of said support assemblies longitudinally therewith when said drive shaft moves longitudinally;

a toothed drive element fixedly associated with said drive shaft and engaged with said chain; and a drive mechanism operably associated with said drive shaft to enable rotation of said toothed drive element rotationally along said chain, to thereby enable movement of said storage system along said flat tracks.

7. The apparatus of claim 6, wherein said secondary track member includes an upwardly extending U-shaped channel, and wherein said chain is fixedly disposed within said channel.

8. The apparatus of claim 6, wherein said toothed drive element comprises a sprocket.

9. The apparatus of claim 6, wherein each one of said support assemblies are secured to its adjacent support assembly by a pair of spaced apart elongated rods to limit said storage system from changing its configuration as said support assemblies are moved along said flat tracks.

10. The apparatus of claim 6, wherein each of said flat tracks comprises a length of flat steel at least 0.1875 inch thick.

11. A storage supporting apparatus disposed on a floor for movably supporting a storage system, wherein the storage system has a plurality of interconnected storage units, said storage supporting apparatus comprising:

a plurality of flat tracks secured to the floor generally parallel to one another and in spaced apart relation to one another;

a corresponding plurality of support assemblies for supporting said storage system movably on said flat tracks;

each of said support assemblies comprising a pair of elongated rods extending within an associated elongated tubular member which interconnects one of said support assemblies to an adjacent said support assembly for providing rigidity to said support assemblies and to thereby inhibit said support assemblies in changing configuration from a rectangle to a parallelogram as said support assemblies are moved longitudinally;

each of said support assemblies further comprising a pair of support wheels mounted for rotational movement to support said storage system for rolling movement on an associated one of said flat tracks, such that all of said support assemblies can be moved simultaneously on said flat tracks, and a pair of guide rollers associated with only one of said support assemblies disposed perpendicular to said associated support wheels of said associated support assembly, each of said guide rollers being disposed closely adjacent to opposing side edges of said flat track on which said associated support wheels are supported to enable said associated said support assembly to move longitudinally along said associated flat track.

12. The apparatus of claim 11, wherein said flat tracks comprise flat steel tracks having a thickness from about 0.1875 inch to 0.5 inch.

* * * * *